United States Patent [19]

Ruf

[11] Patent Number: 4,543,925

[45] Date of Patent: Oct. 1, 1985

[54] LIGHT-ALLOY CYLINDER HEAD FOR RECIPROCATING PISTON INTERNAL COMBUSTION ENGINES

[75] Inventor: Max Ruf, Obereisesheim, Fed. Rep. of Germany

[73] Assignee: Audi Nsu Auto Union Aktiengesellschaft, Fed. Rep. of Germany

[21] Appl. No.: 645,477

[22] Filed: Aug. 29, 1984

[30] Foreign Application Priority Data

Aug. 30, 1983 [DE] Fed. Rep. of Germany ..... 3331145

[51] Int. Cl.[4] ..... F01L 3/22

[52] U.S. Cl. ..... 123/188 S; 123/193 A

[58] Field of Search ..... 123/193 M, 193 R, 188 R, 123/188 S; 29/156.7 R, 156.7 A

[56] References Cited

U.S. PATENT DOCUMENTS

| | | | |
|---|---|---|---|
| 1,523,965 | 1/1925 | Howell | 123/188 S |
| 2,827,031 | 3/1958 | Newton | 123/188 R |
| 3,285,235 | 11/1966 | Ueberschaer | 123/188 S |
| 3,762,381 | 10/1973 | Dave | 123/188 S |
| 4,236,495 | 12/1980 | Rosan | 123/188 S |
| 4,449,492 | 5/1984 | Reynard | 123/188 S |

FOREIGN PATENT DOCUMENTS

| | | | |
|---|---|---|---|
| 2459186 | 6/1976 | Fed. Rep. of Germany | 123/188 S |
| 2816923 | 10/1979 | Fed. Rep. of Germany | 123/193 H |

*Primary Examiner*—Craig R. Feinberg

*Attorney, Agent, or Firm*—Kane, Dalsimer, Kane, Sullivan and Kurucz

[57] ABSTRACT

In order to be able to enlarge the width of web 13 between adjacent valve seating rings 6 of a light-alloy cylinder head 1 for reciprocating internal combustion engines, an external diameter D1 of valve seating surface 11 at the valve seating ring is selected, which is smaller than the external diameter D2 of the total valve seating surface 7. In order nevertheless to give valve seating ring 6 the required strength, the smallest internal diameter D4 is smaller than the internal diameter D3 of the valve seating surface. Throttling the flow is avoided by a transition from D4 to D3, which is advantageous to flow.

1 Claim, 1 Drawing Figure

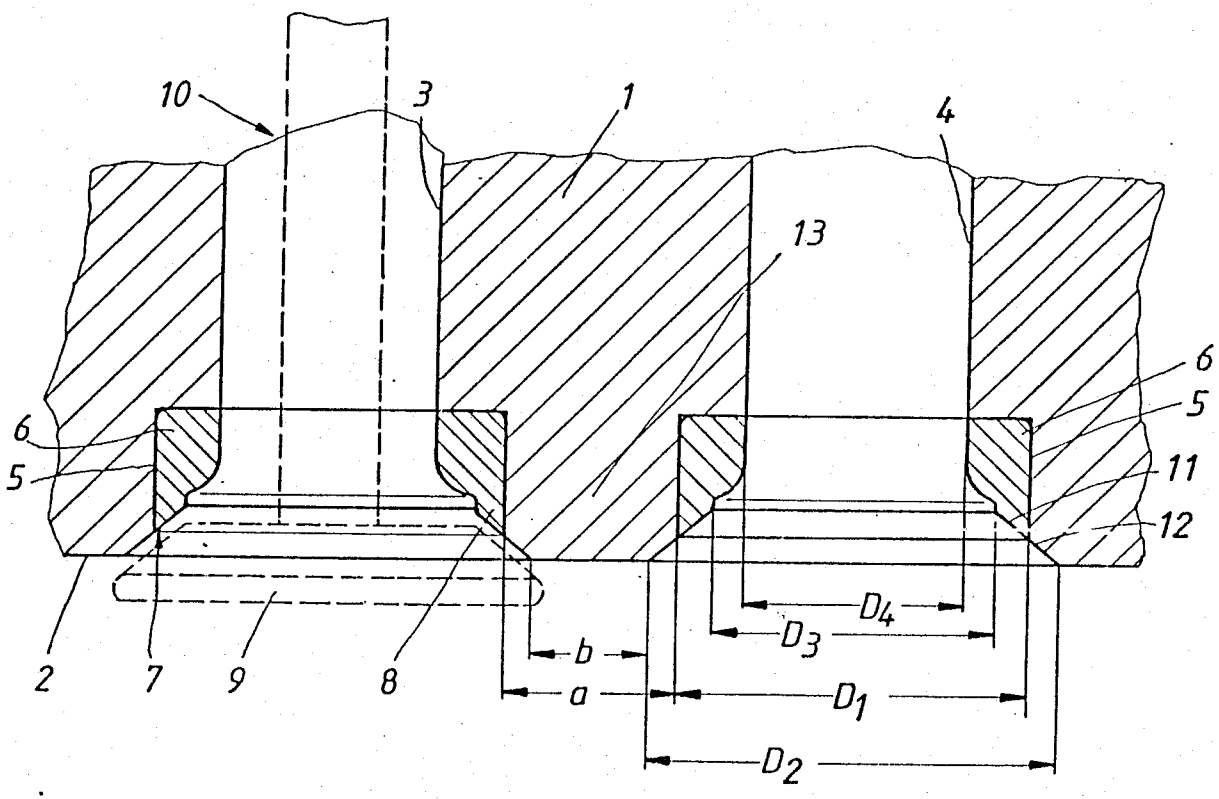
6
5
11
12
4
13
1
3
10
6
5
2
7
9
8
$D_4$
$D_3$
$D_1$
$D_2$
b
a

LIGHT-ALLOY CYLINDER HEAD FOR RECIPROCATING PISTON INTERNAL COMBUSTION ENGINES

The invention relates to a light-alloy cylinder head for reciprocating piston internal combustion engines as defined in the characterizing clause of claim 1.

Usually (see, for example, the German Offenlegungsschrift No. 2,950,964), the opening of the gas exchange ports in the bottom surface of the cylinder head are provided with circular recesses, in which the valve seating rings are inserted, which in turn extend up to the bottom surface of the cylinder head and have a cone-shell-shaped internal circumferential wall, which forms the valve seating surface for the valve head. The remaining web between adjacent valve seating rings of a cylinder is exposed to high, alternating, thermal stresses, so that its width may not fall below a certain minimum value. In order to reduce the thermal stresses on this web, it is known (German Pat. No. 937,858) that neighboring valve seating rings may be constructed adjacent to each other along plane surfaces, so that these cover the web opposite the combustion chamber and consequently protect the web against the section of heat. Admittedly, by so doing, there is the possibility of increasing the horsepower rating of the internal combustion engine by enlarging the diameter of the inlet and exhaust valves without endangering the web. However, manufacturing problems arise since the recesses, which hold the valve seating rings, overlap, so that the machining of these recesses, before the valve seating rings are inserted, is made difficult and the thermal expansion of the valve seating rings, whose plane surfaces must lie as close together as possible in the installed state, is obstructed. It is moreover more expensive to manufacture valve seating rings, which are not completely circular.

It is an object of the invention to provide a light-alloy cylinder head of the type described, in which inlet and exhaust valves of large diameter are made possible without endangering the web between the valve seating rings and also without symmetrical construction of the valve seating rings.

This objective is accomplished inventively by the characteristic features as described herein.

In the inventive proposal the total valve seating surface is not, as is customary, formed only by the valve seating ring, but, at least after a certain running-in time, also by a ring surface of the light alloy surrounding the valve seating ring. In an internal combustion engine, in which the valve seating surface is formed in the previously customary manner by the valve seating ring alone, an enlargement of the diameters of the inlet and exhaust valves and therefore an increase in the horsepower rating can be achieved without reducing the web width between adjacent valve seating rings.

If necessary for achieving the required strength of the valve seating ring, the smallest internal diameter of the ring can be kept smaller than the internal diameter of the valve seating surface at the valve seating ring, charge losses being avoided by a flow-favoring transition from this smallest internal diameter to the internal diameter of the valve seating surface.

BRIEF DESCRIPTION OF DRAWING

An example of the operation of the invention is described in the following with reference to the drawing, in which a cross section through a cylinder head is shown.

A light-alloy cylinder head 1 for a reciprocating piston internal combustion engine lies with its bottom surface 1 on a cylinder block, which is not shown. For each cylinder, cylinder head 1 has inlet and exhaust ports 3 and 4, respectively, which, in their region adjacent to bottom surface 2, are provided with circular recesses 5 for holding a heavy metal valve seating ring 6. Each control opening 3, 4 is provided adjacent to bottom surface 2 with a valve seating surface 7 in the form of a cone-shell-shaped shell, which acts together with the complementarily shaped sealing surface 8 of a valve head 9 of a poppet valve 10, which is shown by a broken line in the drawing. Such a poppet valve is shown in the drawing only in conjunction with port 3, although there is of course a corresponding valve for port 4.

The external diameter D1 of valve seating ring 6 is smaller than the external diameter D2 of valve seating surface 7. Therefore, at least after a certain running-in time, valve seating surface 7 is formed by cone-shaped shell surface 11 at the front face of valve seating ring 5 and by cone-shaped shell surface 12 the cylinder block 1. Through this design, the possibility arises of constructing web 13 between valve seating rings 5 so as to have a relatively large width a, while with the conventional design of the valve seating ring, for which the valve seating surface lies within the valve seating rings, only a width b would be possible. In order to achieve, for a given internal diameter D3 of valve seating surface 7, whose size is determined by the desired horsepower rating of the internal combustion engine, a valve seating ring 5 of sufficient strength without enlarging its external diameter D1, the wall thickness of valve seating ring 5 can be enlarged at its end away from bottom surface 2, so that its smallest internal diameter D4 is smaller than the internal diameter D3 of sealing surface 7. The transition from D4 to D3 is such as to favor flow, that is, it has no sharp edges or corners, in order to avoid gas exchange losses due to turbulence as far as possible.

I claim:

1. A light alloy cylinder head for reciprocating piston internal combustion engines comprising:

a bottom surface with gas-exchange openings controlled by poppet valves with valve heads, said openings having edges defining first valve seating surfaces (12) with a first outer diameter (D2); and reinforcing rings disposed in said openings and having second valve seating surfaces (11) with a second outer diameter (D1) smaller than said first outer diameter;

said first and second valve seating surfaces correspondingly being beveled at a common angle cooperating to form total valve seating surfaces for each of said valve heads, wherein said second valve seating surfaces have a first internal diameter (D3) and said rings have intermediate circumferential walls reduced from said first internal diameter (D3) to a second internal diameter (D4), said intermediate walls being shaped for advantageous gas flow through said openings.

* * * * *